US006257283B1

(12) United States Patent
Lenzi

(10) Patent No.: US 6,257,283 B1
(45) Date of Patent: Jul. 10, 2001

(54) METHOD AND APPARATUS FOR MANUFACTURING TEXTILE ARTICLES WITH AN UNDERLYING WARP AND AN ADDITIONAL WARP

(76) Inventor: Leonardo Lenzi, Via Vecchia Fiorentina II Tronco 229 H, 51039, Quarrata (IT)

( * ) Notice: Subject to any disclaimer, the term of this patent is extended or adjusted under 35 U.S.C. 154(b) by 0 days.

(21) Appl. No.: 09/287,148

(22) Filed: Apr. 6, 1999

(30) Foreign Application Priority Data

Apr. 3, 1998 (IT) ..... FI98A0083

(51) Int. Cl.[7] ..... D03C 5/04; D03C 7/06; D03D 13/00

(52) U.S. Cl. ..... 139/50

(58) Field of Search ..... 139/54, 48, 50

(56) References Cited

U.S. PATENT DOCUMENTS 3,463,199 * 8/1969 Crenshaw et al. ..... 139/54
4,429,722 * 2/1984 Herzog ..... 139/48
6,009,917 * 1/2000 Meyns et al. ..... 139/54

* cited by examiner

*Primary Examiner*—Andy Falik
(74) *Attorney, Agent, or Firm*—McGlew and Tuttle, P.C.

(57) ABSTRACT

According to the invention, the manufacturing of a textile article comprises weaving an article with one or more wefts and at least one additional warp. The threads of the warp are moved orthogonally to those of the underlying warp before inserting the weft threads. Loom elements are provided for orthogonal warp movement.

3 Claims, 5 Drawing Sheets

METHOD AND APPARATUS FOR MANUFACTURING TEXTILE ARTICLES WITH AN UNDERLYING WARP AND AN ADDITIONAL WARP

FIELD OF THE INVENTION

The present invention refers to a method and apparatus for manufacturing textile articles with at least one additional warp.

BACKGROUND OF THE INVENTION

As it is well known, a fabric is obtained by interweaving two series of threads which are disposed orthogonally one to the other. On the loom, the warp threads are prepared in advance in predetermined number and length, and are longitudinally stretched parallel to each other. Interwoven between the suitably displaced weft threads, and perpendicular thereto, are the warp threads to form thereby the fabric. Formed on the sides of the fabric, to delimit the height thereof, are the two selvages which make up the edges of the same fabric.

The fabrics may be classified in relation to their intended use (clothing, interior design and technical fabrics), as well as to the interlaces that form them and to the elements which contribute to their formation. In this respect, four categories of fabrics may be defined. The simpler fabrics, formed by one warp and one weft, belong to the first category. Belonging to the second category are the fabrics formed by one warp and two or more wefts. The third category includes fabrics with two or more warps. Finally, the fourth category refers to fabrics exhibiting two or more warps and two or more wefts.

In particular, the fabrics of the third category, with two chains and only one series of wefts, have a so-called "underlying" warp intended to link the wefts; the other warp, which has instead the function of achieving either a solid or patterned effect, is called "additional" warp. Since the additional warp has a different evolution from the underlying one, the warping is provided on two distinct beams. Shown in FIG. 7 is the profile of a warp belonging to a fabric of this type, where T indicates the weft, PO the first warp and SO the second warp. It should be noted that the additional warp develops orthogonally to the weft, likewise the underlying warp.

SUMMARY AND OBJECTS OF THE INVENTION

The weaving thus operated makes it possible to achieve only effects and patterns which are developed on the same plane of the fabric.

The main object of the present invention is to provide a method and an apparatus allowing the obtainment of non-linear effects, also of raised type, on fabrics belonging to the above mentioned third and fourth categories.

This result has been achieved, according to the invention, by providing a method and an apparatus having the features indicated in the independent claims. Further characteristics being set forth in the dependent claims.

By adopting the method according to the invention it is possible to manufacture fabrics suitable for clothing and interior design, and technical fabrics as well, with non linear effects, also of raised type, which can provide the fabrics for clothing and interior design with such aesthetical characteristic very much like those of knitted fabrics or those having embroideries or ornaments, and give the technical fabrics preset structural characteristics.

Moreover, an apparatus for carrying out the method according to the invention is relatively simple to make, cost-effective, reliable even after a prolonged service life and capable of being fully automated.

These and other advantages and characteristics of the invention will be best understood by anyone skilled in the art from a reading of the following description in conjunction with the attached drawings given as a practical exemplification of the invention, but not to be considered in a limitative sense

DETAILED DESCRIPTION OF THE PREFERRED EMBODIMENTS

Figure 1:
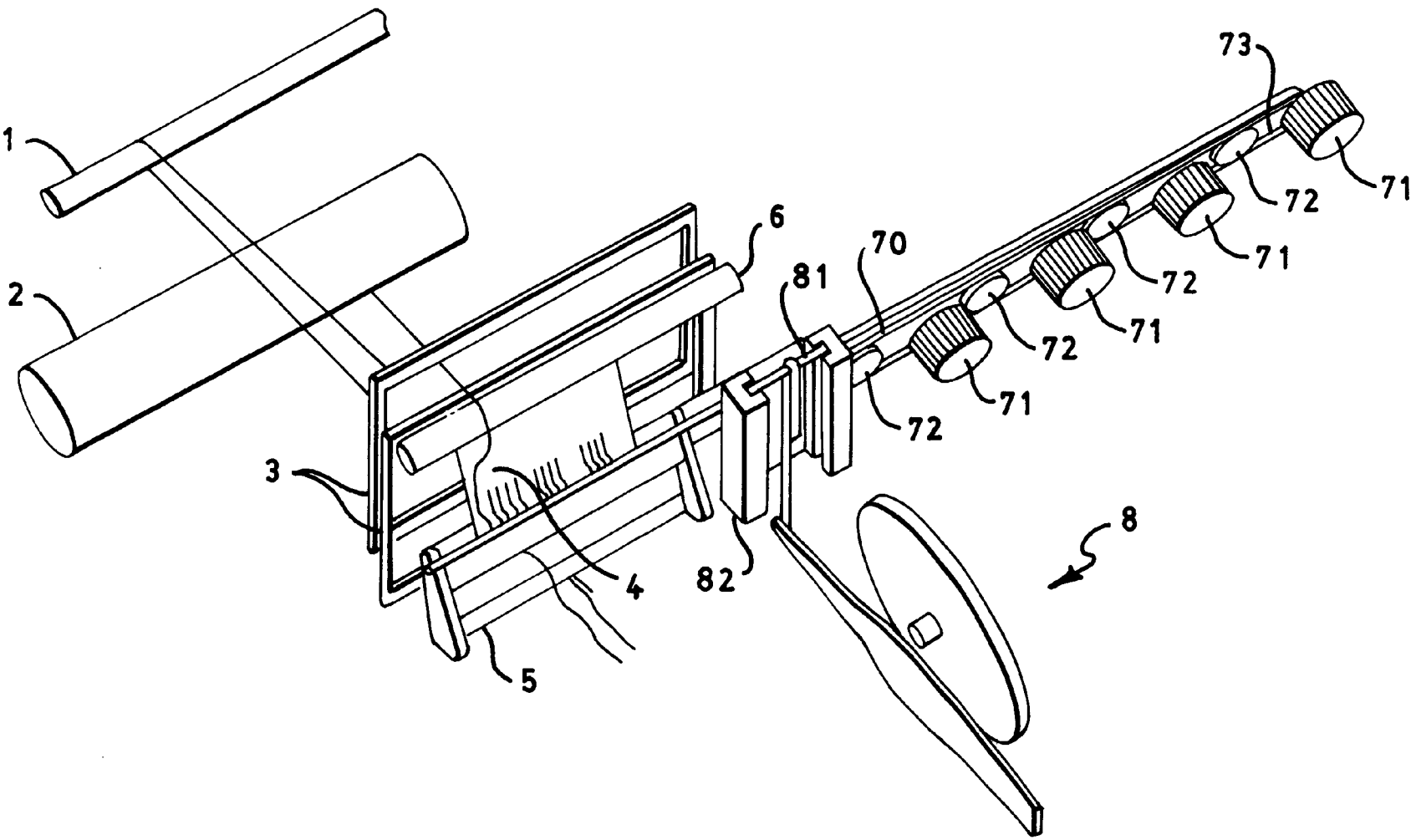
FIG. 1 is a schematic ensemble view of a loom provided with an apparatus according to the invention.

For the manufacturing of an article according to the invention, a loom is used comprising:

- a beam located rearwardly, on which the threads of the underlying warp have been previously wound;
- a set of heddles made up of a metal frame to which corresponding loops have been applied transversally to the direction of development of the fabric in the course of formation and through which the warp threads are made to pass;
- a member for controlling the lease, that is, the up and down movement of the heddles which is transmitted to the warp threads to move even threads away from odd threads, thereby forming an opening or shed through which the weft is passed;
- a shuttle or other operatively equivalent member for the transfer of the weft thread and its insertion between the warp threads according to the desired weave ratio;
- a reed which, suspended between the warp threads, is connected to the sley and, upon each transit of the shuttle, pushes the weft threads, by moving them close to each other, to form the fabric which is gradually wound up around a storing roller.

Moreover, provision is made for a second beam for at least an additional warp.

Schematically represented in the figures of the attached drawings are the following loom elements:

- the beam 1 for the underlying warp 10;
- the beam 2 for the additional warp 20;
- the heddles looms 3;
- the reed 4 for passing the threads 10 of the underlying warp;
- the sley 5, supporting the reed 4, for bringing the weft threads close to each other;
- a cylinder 6 for guiding the additional warp and positioned above the reed 4 so as to have the threads 20 of the additional warp passing over said reed.

Advantageously, according to the invention, means are provided for controlling the movement of a predetermined number of threads 20 of the additional warp, in a direction orthogonal to that of threads 10 of the underlying warp, before operating the insertion of the weft.

Figure 2:
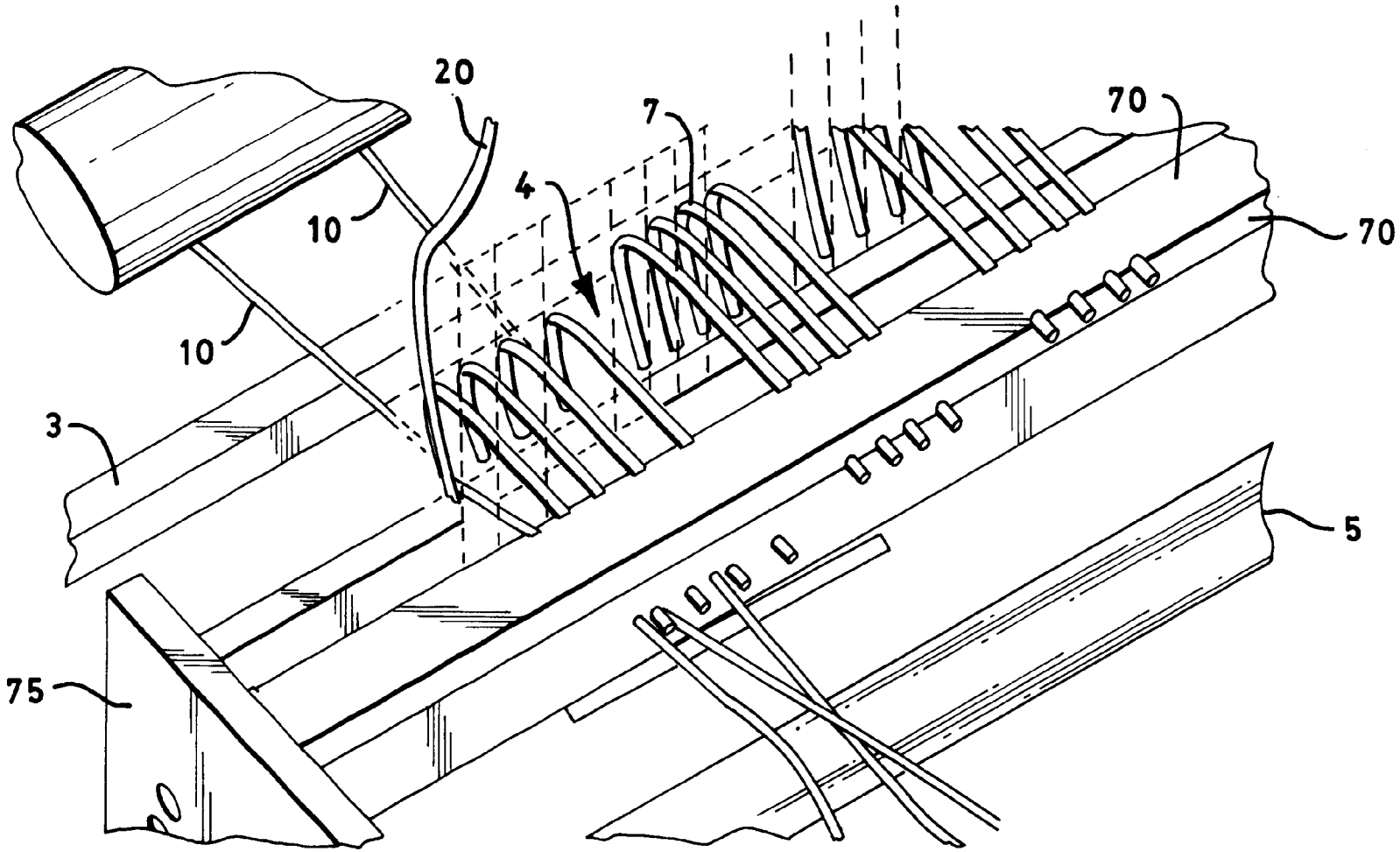
FIG. 2 shows a detail of the group of FIG. 1, with the reed being open.
Figure 3:
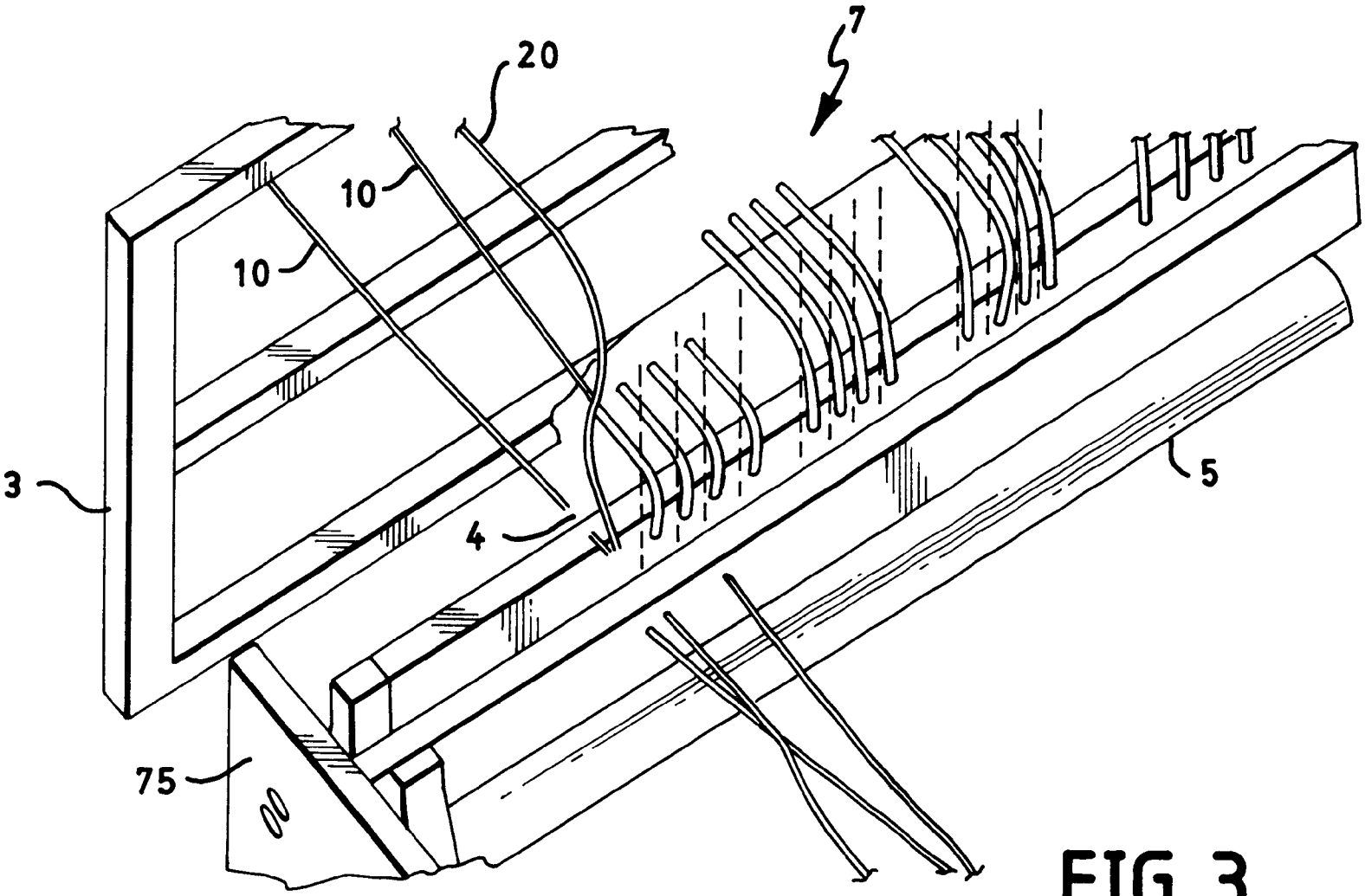
FIG. 3 shows a detail as in FIG. 2 but with the reed being closed.
Figure 4:
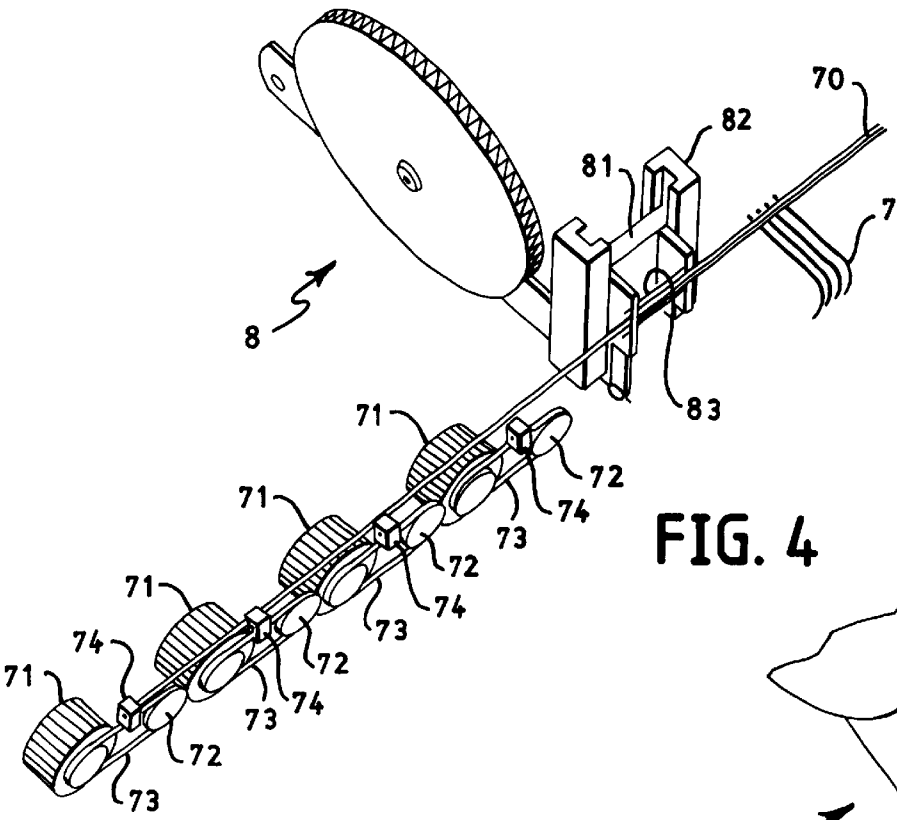
FIG. 4 shows a bar for driving the curved rods, with the members for the translation thereof.
Figure 5:
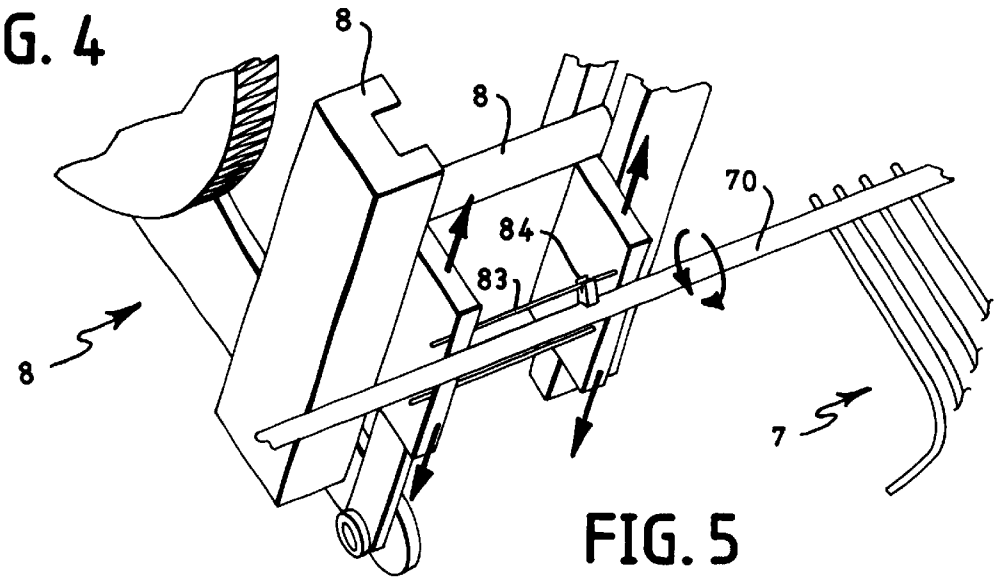
FIG. 5 shows and enlarged detail of the group of FIG. 5 and the means intended to drive said rod into rotation.
Figure 6:
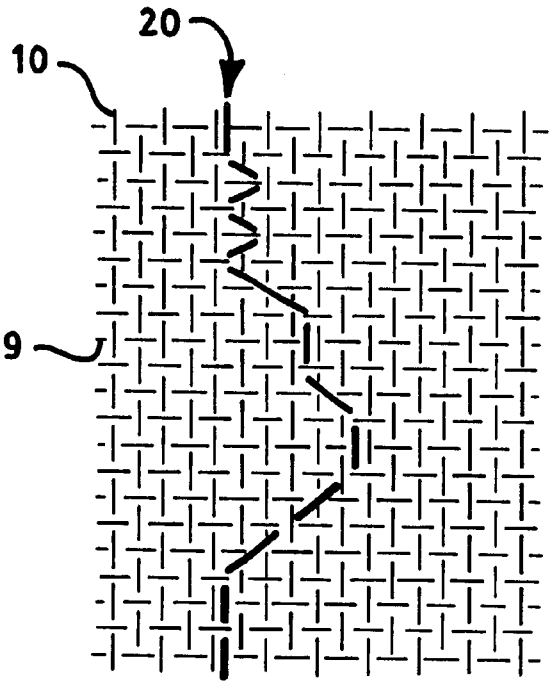
FIG. 6 is a diagram of an effect that may be obtained by implementing the method according to the invention.
Figure 7:
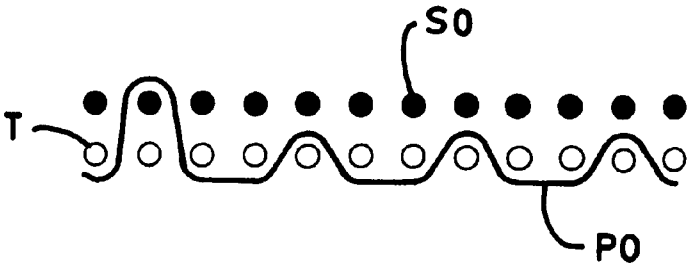
FIG. 7 shows the profile of a warp belonging to a fabric having an underlying warp of traditional type.

According to a possible embodiment of the present invention, said means for moving the threads 20 of the additional warp comprise more groups of curved rods 7 with their concave part facing upwards, the rods 7 of each group being mounted on a corresponding support and control bar 70 located downstream of the reed 4 and above the sley 5, so that each of said rods 7 will have a portion engaged to the respective bar 70, and a portion with the free end of the latter facing the reed 4. Said bars 70 are developed orthogonally to the direction of development of the underlying warp and driven into rotation about their respective longitudinal axes and into translation in the direction of same axes. The extent of said translation varying in relation to the effect which is to be obtained. The curvature and length of said rods 7 are suitably chosen so that, once activated, the same rods will result as close as possible to the reed 4 when the latter is opened up (as illustrated in FIG. 2). In this way, only the additional threads will thereby be affected and disposed in a position suitable for the subsequent insertion of the weft.

In order to reduce the overall dimensions of the whole apparatus, said bars 70 are able to be positioned in overlapping relationship, that is, with the respective longitudinal axes lying all in a same vertical plane.

Each of said bars 70 is associated to a corresponding driving member 71 provided with a reducer 72 and a transmission belt 73 connected to the relevant bar 70 by a fixing block 74. In this way, each bar 70 will result independent of the others as far as its translation, that is, the extent of translation to which the curved rods 7 mounted thereon are associated, is concerned. This makes it possible to significantly broaden the range of the obtainable effects. The bars 70 are carried by a corresponding frame 75. The means for controlling the rotation of the bars 70 about their respective longitudinal axis comprise a transmission group 8 of crank-connecting rod type to drive a slide 81 into vertical translation, the said slide being received in a vertically sliding guide 82 intended to support a plurality of straight rods 83 (in a number equal to that of bars 70) each of which is fixed to the slide 81, parallel to the corresponding bar 70, and is connected to the latter by a block 84 which, on one side is secured to the bar 70, and on the opposite side has a fork-like recess for the rod 83 sliding therein.

Cyclically, upon the weaving of the article and prior to the insertion of the weft, the rods 7 of each group are made to translate by the respective bars 70, according to the preset warping program, in order to guide the relevant additional warp threads 20 in a direction orthogonal to that of the underlying warp threads 10 and then to rotate to clear the region of reed 4.

Both the underlying and additional warps may be associated to corresponding recovery devices of traditional type to make for any slack arising from the movement of the respective threads 10, 20.

Accordingly, a method according to the invention comprises the weaving of an article with a weft 9 and two warps, developing from corresponding beams, and one of which is called "underlying warp" and the other "additional warp". During the weaving, that is, the interlace formation of the weft threads with the threads of the said two warps, the threads 20 of the additional warp are moved in a direction parallel to that of the weft threads, that is, perpendicularly to the threads 10 of the underlying warp. The driving of the threads 20 of additional warp into motion parallel to weft threads is accomplished before the insertion of the latter. The number of rods 7 for each bar 70 varies according to the required effects. As a borderline case, on one or more bars 70 of the present apparatus there may be provided a single curved rod 7.

The method and apparatus according to the present invention can be applied to the manufacturing of clothing or interior design fabrics, as well as of technical fabrics made, for example, from glass or carbon fibres, or the like. In the case of clothing and interior design fabrics it is possible to obtain ornamental effects, with a diagonal pattern of the additional threads over predetermined region of the fabric, as well as with a raised pattern, through a proper choice of the count of the yarns, used for the additional warp, and of the travel of the curved rod 7—such effects being comparable to those obtainable from far more complex units, and located at separate work stations, such as the embroidering machines. The apparatus in question makes it possible in any case to have a additional warp developed parallel to the underlying warp. To this end, it will be sufficient to suppress the translation of the curved rods 7. In case of technical fabrics, the programmable effects give rise to a greater structural solidity and rigidity of some regions of the article with respect to others.

It will be appreciated that although the example above described with reference to the figures of the attached drawings relates to a case of only one additional or additional warp, the same technique is applicable to the case of more additional warps. Similarly, the method and apparatus according to the invention apply also to the case of fabrics with two or more wefts and two or more warps.

The threads 20 of the additional warp may also develop direct from corresponding reels, possibly positioned on a creel located upstream of the weaving machine. Moreover, the formation of the warp opening may be obtained from heddles, as schematically represented in FIG. 1, or from a jacquard.

Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

What is claimed is:

1. Apparatus for manufacturing textile articles with one or more wefts, an underlying warp and at least an additional warp, comprising weaving means to form an orderly interlace of threads of weft, underlying warp and additional warp, characterized in that it comprises means for moving the threads of the additional warp in a direction orthogonal to that of the threads of the underlying warp: said means for moving the additional warp threads being activated to operate said movement before activating the means for the insertion of the weft, said weaving means including a reed for passing the threads of the underlying warp and a sley for supporting the reed, and in that said means for moving the threads of at least the additional warp comprise a set of curved rods disposed on corresponding support bars located downstream of the reed, so that each of said rods will have a portion engaged to the respective bar, and a portion with the free end of the latter facing the reed, said bars being able to be individually translated, in a direction parallel to that of development of the weft threads, under control of respective driving members.

2. Apparatus according to claim 1, characterized in that said bars are so mounted as to be individually rotatable about their respective longitudinal axis.

3. Apparatus according to claim 1, characterized in that said bars for supporting the curved rods are disposed in overlapping relationship, that is with the respective longitudinal axes lying all on a same vertical plane.

* * * * *